US012490796B2

(12) United States Patent
Lee et al.

(10) Patent No.: US 12,490,796 B2
(45) Date of Patent: Dec. 9, 2025

(54) SHIELD ROTATION CONTROLLING MEANS

(71) Applicant: HJC CORP., Gyeonggi-do (KR)

(72) Inventors: Jin Hwan Lee, Gyeonggi-do (KR); Ki Young Nam, Seoul (KR)

(73) Assignee: HJC CORP., Gyeonggi-do (KR)

( * ) Notice: Subject to any disclaimer, the term of this patent is extended or adjusted under 35 U.S.C. 154(b) by 99 days.

(21) Appl. No.: 18/553,860

(22) PCT Filed: Feb. 17, 2022

(86) PCT No.: PCT/KR2022/002312
§ 371 (c)(1),
(2) Date: Oct. 4, 2023

(87) PCT Pub. No.: WO2022/215856
PCT Pub. Date: Oct. 13, 2022

(65) Prior Publication Data

US 2024/0180282 A1 Jun. 6, 2024

(30) Foreign Application Priority Data

Apr. 7, 2021 (KR) ..... 10-2021-0045056

(51) Int. Cl.
*A42B 3/22* (2006.01)

(52) U.S. Cl.
CPC ..... *A42B 3/223* (2013.01)

(58) Field of Classification Search
CPC ..... A42B 3/223; A42B 3/222; A42B 3/221; A42B 3/22; A42B 3/04; A42B 3/0406; A42B 1/24
USPC ..... 2/6.5
See application file for complete search history.

(56) References Cited

U.S. PATENT DOCUMENTS

| | | | | | |
|---|---|---|---|---|---|
| 3,548,411 | A * | 12/1970 | Barstow | A42B 3/228 | 351/44 |
| 4,292,688 | A * | 10/1981 | Ellis | A42B 3/223 | 16/335 |
| 5,062,162 | A * | 11/1991 | Kamata | A42B 3/222 | 2/424 |
| 5,461,731 | A * | 10/1995 | Shida | A42B 3/222 | 2/424 |
| 5,987,651 | A * | 11/1999 | Tanaka | A42B 3/223 | 2/424 |
| 2002/0189005 | A1 * | 12/2002 | Taniuchi | A42B 3/223 | 2/424 |

(Continued)

FOREIGN PATENT DOCUMENTS

| | | |
|---|---|---|
| CN | 103054254 | 4/2013 |
| DE | 102009051780 | 1/2011 |

(Continued)

*Primary Examiner* — Amy Vanatta
(74) *Attorney, Agent, or Firm* — DUANE MORRIS LLP; Gregory M. Lefkowitz; Daniel J. Tarr

(57) ABSTRACT

The present disclosure relates to a shield rotation controlling means. The shield rotation controlling means according to the present disclosure comprises: a support member (100) supporting a shield (20) and rotating about a base member (300); and a stopping means (200) coupled to the support member (100) and provided with elasticity in the direction of the base member (300), the support member (100) stopped by means of the elasticity of the stopping means (200).

18 Claims, 10 Drawing Sheets

(56) References Cited

U.S. PATENT DOCUMENTS

| | | | | |
|---|---|---|---|---|
| 2004/0049830 | A1 | 3/2004 | Gafforio | |
| 2006/0230507 | A1 | 10/2006 | Yeh | |
| 2007/0074335 | A1* | 4/2007 | Gafforio | A42B 3/223 2/410 |
| 2009/0038057 | A1* | 2/2009 | Tews | A42B 3/223 2/427 |
| 2011/0094019 | A1* | 4/2011 | Isobe | A42B 3/222 2/424 |
| 2012/0117718 | A1 | 5/2012 | Cho | |
| 2012/0144566 | A1 | 6/2012 | Hunt | |
| 2013/0340148 | A1 | 12/2013 | Arai | |
| 2014/0352020 | A1* | 12/2014 | Isobe | A42B 3/223 2/9 |
| 2022/0361620 | A1* | 11/2022 | Lu | A42B 3/221 |
| 2022/0408868 | A1* | 12/2022 | Isobe | A42B 3/223 |
| 2024/0130460 | A1* | 4/2024 | Park | A42B 3/223 |

FOREIGN PATENT DOCUMENTS

| | | | | |
|---|---|---|---|---|
| EP | 2526801 | | 11/2012 | |
| FR | 2493686 | | 5/1982 | |
| JP | 07-207511 | | 8/1995 | |
| JP | 08-232111 | | 9/1996 | |
| KR | 20020090634 | A * | 12/2002 | |
| KR | 20080083924 | A * | 9/2008 | |
| WO | WO-2019092297 | A1 * | 5/2019 | A42B 3/221 |

* cited by examiner

SHIELD ROTATION CONTROLLING MEANS

CROSS-REFERENCE TO RELATED APPLICATIONS

This application is a § 371 national stage entry of International Application No. PCT/KR2022/002312, filed on Feb. 17, 2022, which claims priority to Korean Patent Application No. 10-2021-0045056, filed on Apr. 7, 2021, the entire contents of which are incorporated herein by reference.

TECHNICAL FIELD

The present disclosure relates to a shield rotation control means.

BACKGROUND ART

In general, it is mandatory to wear a helmet while driving a two wheeled vehicle with high speed to protect the wearer's head. The helmet has a front open portion to ensure the wearer's frontal field of view. Additionally, the helmet may include a shield that can selectively open and close the open portion to keep out wind, dust, etc. while driving.

Meanwhile, the motorcycle helmet according to the prior art features the shield that rotates around a rotation axis as disclosed in the patent literature of the related literatures described below. However, technology to stably stop the shield at a predetermined position during the rotation lacks in the motorcycle helmet according to the prior art.

RELATED LITERATURES

Patent Literature (Patent Literature 1) KR10-2014-0001141 A

DISCLOSURE

Technical Problem

The present disclosure is designed to solve the above-described problem, and an aspect of the present disclosure relates to a shield rotation control means for stably stopping a shield coupled to a support member at a predetermined position by stopping the support member using a stopper means having elasticity during rotation of the support member.

Technical Solution

A shield rotation control means according to an embodiment of the present disclosure includes a support member which supports a shield and rotates with respect to a base member, and a stopper means which is coupled to the support member, wherein an elastic force is provided toward the base member, and wherein the support member is stopped by the elastic force of the stopper means.

Additionally, in the shield rotation control means according to an embodiment of the present disclosure, the stopper means is rotatably coupled to the support member around a rotation axis, and the stopper means includes an elastic means to provide the elastic force to rotate the stopper means around the rotation axis in one direction.

Additionally, in the shield rotation control means according to an embodiment of the present disclosure, the stopper means includes a first hook portion, an auxiliary member coupled to the base member or the base member includes a second hook portion coupled to the first hook portion, and the elastic means provides the elastic force in a direction in which the first hook portion is coupled to the second hook portion.

Additionally, in the shield rotation control means according to an embodiment of the present disclosure, the stopper means includes a protruding portion which protrudes toward the base member, the base member has a slot extended along a direction in which the support member rotates, and when the support member rotates with respect to the base member, the protruding portion slides along the slot.

Additionally, in the shield rotation control means according to an embodiment of the present disclosure, a first recessed portion recessed in a direction of the elastic force of the elastic means provided to the protruding portion is formed at a first end of the slot, and the protruding portion is coupled to the first recessed portion.

Additionally, in the shield rotation control means according to an embodiment of the present disclosure, a second recessed portion recessed in a direction of the elastic force of the elastic means provided to the protruding portion is formed at a second end of the slot, and the protruding portion is coupled to the second recessed portion.

Additionally, in the shield rotation control means according to an embodiment of the present disclosure, a first coupling portion extended to be angled is formed at one side of the second recessed portion, a second coupling portion recessed to be angled to conform to the first coupling portion is formed at one side of the protruding portion, and when the protruding portion is coupled to the second recessed portion, the first coupling portion and the second coupling portion come into contact with each other.

Additionally, in the shield rotation control means according to an embodiment of the present disclosure, a noise absorber member is present between the stopper means and the base member.

Additionally, in the shield rotation control means according to an embodiment of the present disclosure, the noise absorber member is rotatably coupled to the support member, and the noise absorber member contacts the base member by the elastic force of the stopper means.

Additionally, in the shield rotation control means according to an embodiment of the present disclosure, the noise absorber member is made of silicone.

Additionally, the shield rotation control means according to an embodiment of the present disclosure includes an elastic member disposed in any one of the support member and the base member such that the elastic member protrudes in a curved shape toward the other one of the support member and the base member, and a serrated portion formed in the other one of the support member and the base member such that the serrated portion is extended along a direction in which the support member rotates, and when the support member rotates with respect to the base member, the elastic member moves along the serrated portion.

Additionally, in the shield rotation control means according to an embodiment of the present disclosure, the serrated portion includes a first groove having a curvature corresponding to a curvature of the elastic member at one end, and a second groove having a curvature corresponding to the curvature of the elastic member at an opposite end, and the serrated portion includes multi-grooves having a larger curvature than the curvature of the elastic member between the first groove and the second groove.

Additionally, in the shield rotation control means according to an embodiment of the present disclosure, the serrated portion includes a third groove having a curvature corresponding to the curvature of the elastic member at a predetermined distance from the first groove.

Additionally, in the shield rotation control means according to an embodiment of the present disclosure, the base member includes a projecting portion which protrudes toward the support member so that the projecting portion is held against one side of the support member, and the elastic force acts on the projecting portion toward the base member.

The features and advantages of the present disclosure will be apparent from the following detailed description in accordance with the accompanying drawings.

Prior to the description, it should be understood that the terms or words used in the specification and the appended claims should not be construed as limited to general and dictionary meanings, but rather interpreted based on the meanings and concepts corresponding to the technical spirit of the present disclosure on the basis of the principle that the inventor is allowed to define terms appropriately for the best explanation.

Advantageous Effects

According to the present disclosure, it may be possible to stably stop the shield coupled to the support member at the predetermined position by stopping the support member using the stopper means having elasticity during rotation of the support member.

BEST MODE

The objectives, particular advantages and new features of the present disclosure will be apparent from the following detailed description and exemplary embodiments in association with the accompanying drawings. In affixing the reference numbers to the elements of each drawing in the present disclosure, it should be noted that identical elements are given as identical numbers as possible although they are depicted in different drawings. Additionally, the terms such as "first", "second" or the like are used to distinguish one element from another, and the elements are not limited by the terms. Hereinafter, in describing the present disclosure, when it is determined that a certain description of related known technology may unnecessarily obscure the subject matter of the present disclosure, the detailed description is omitted.

Hereinafter, exemplary embodiments of the present disclosure will be described in detail with reference to the accompanying drawings.

Figure 1A:
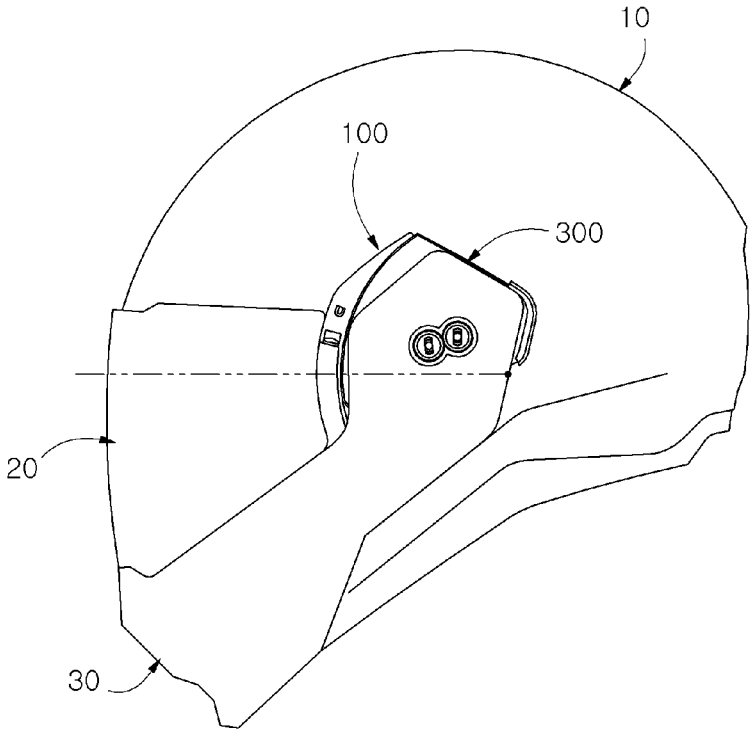
FIGS. 1A and 1B are side views of a helmet with a shield rotation control means according to an embodiment of the present disclosure.
Figure 1B:
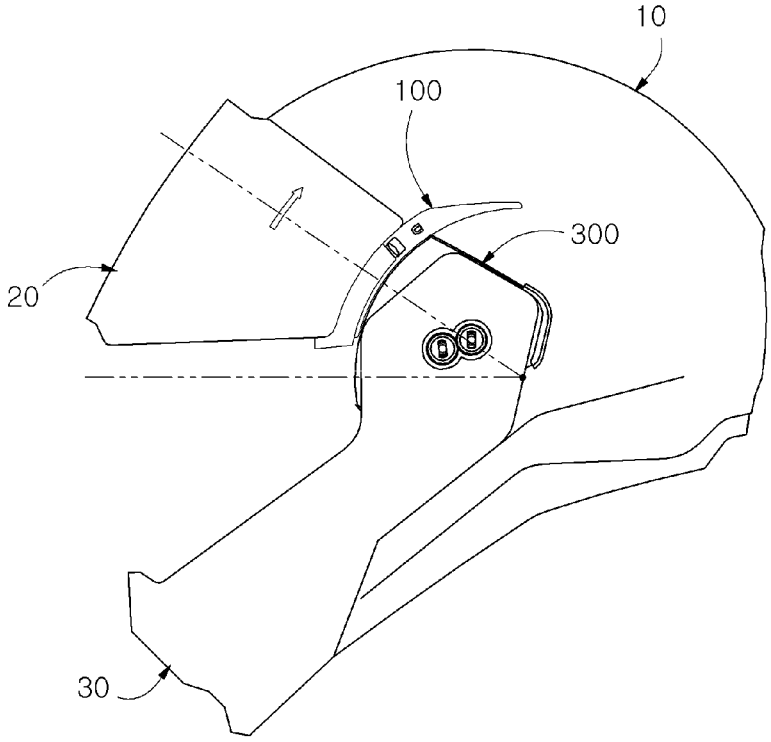
Figure 2:
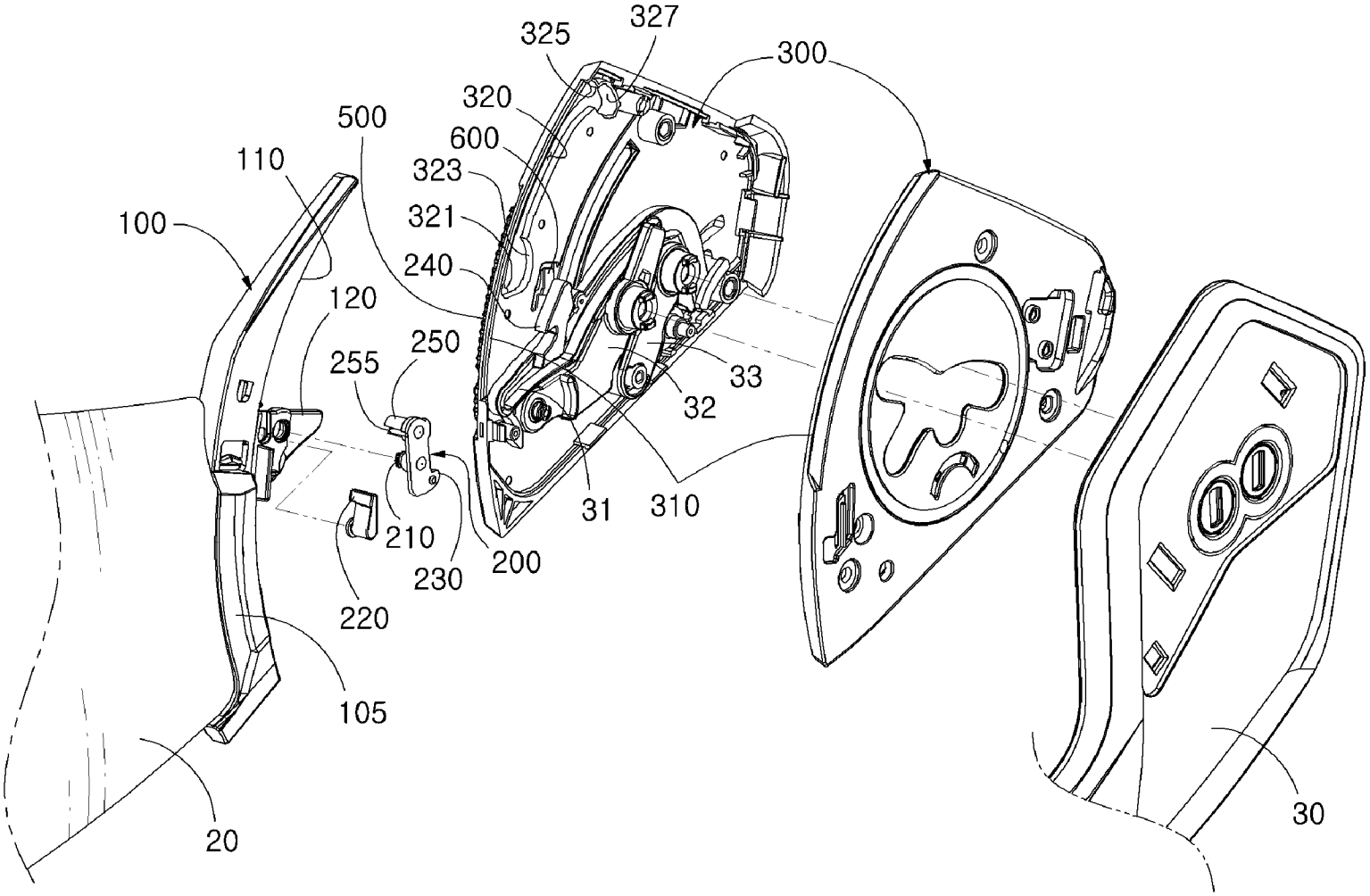
FIG. 2 is an exploded perspective view of a shield rotation control means according to an embodiment of the present disclosure.
Figure 3:
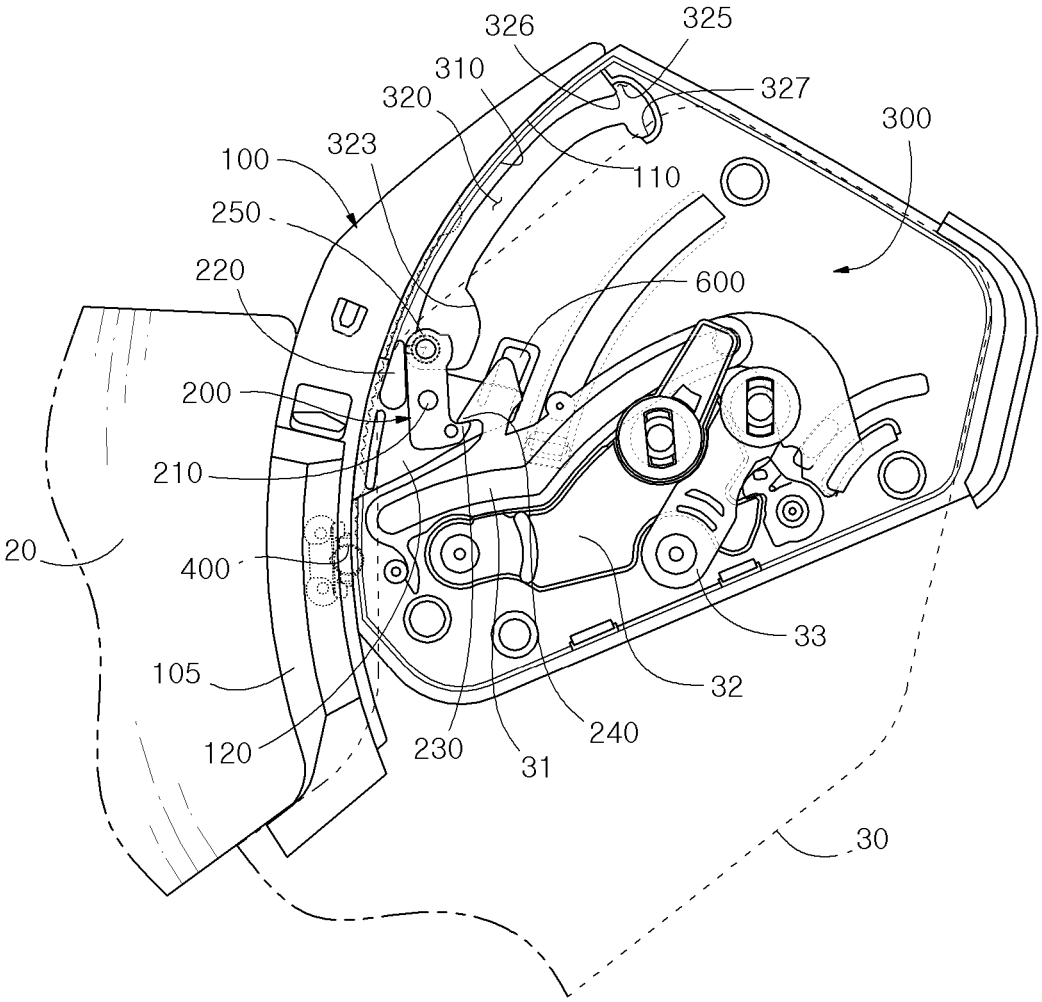
FIG. 3 is a plan diagram of a shield rotation control means according to an embodiment of the present disclosure.
Figure 4:
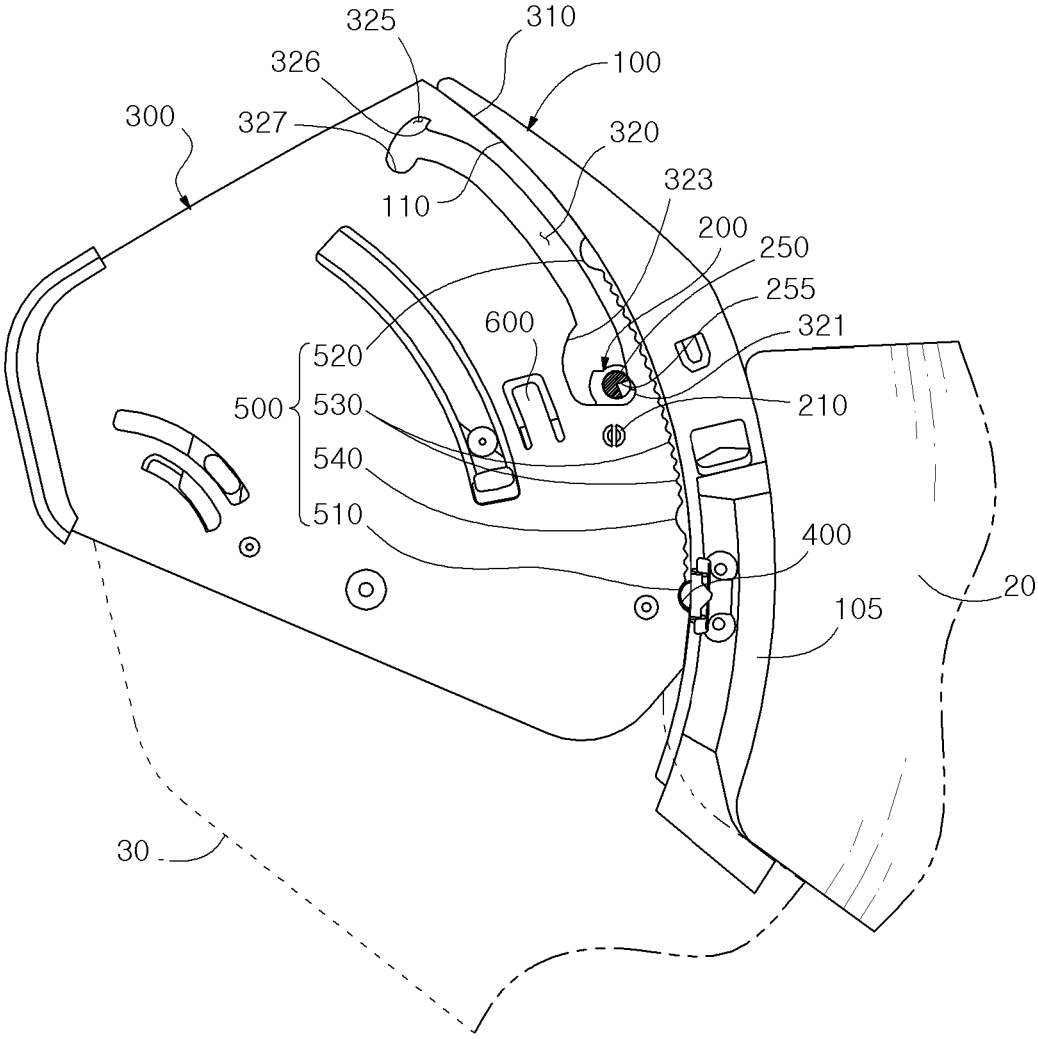
FIG. 4 is a rear view of a shield rotation control means according to an embodiment of the present disclosure.

FIGS. 1A and 1B are side views of a helmet with a shield rotation control means according to an embodiment of the present disclosure, FIG. 2 is an exploded perspective view of the shield rotation control means according to an embodiment of the present disclosure, FIG. 3 is a plan diagram of the shield rotation control means according to an embodiment of the present disclosure, and FIG. 4 is a rear view of the shield rotation control means according to an embodiment of the present disclosure.

As shown in FIGS. 1 to 4, the shield rotation control means according to this embodiment includes a support member 100 that supports a shield 20 and rotates with respect to a base member 300, and a stopper means 200 that is coupled to the support member 100, and in which an elastic force is provided toward the base member 300, and the support member 100 is stopped by the elastic force of the stopper means 200.

As shown in FIGS. 1A and 1B, a helmet body 10 plays a role in protecting a wearer's head. The helmet body 10 may be made of a shock absorbing material. For example, the helmet body 10 may include an outer shell of hard synthetic resin and having high strength, and an absorber disposed in the outer shell, made of an expanded polystyrene (EPS) foam and having proper strength and elasticity. A pad may be present inside the absorber to improve a snug fit.

Additionally, the shield 20 plays a role in opening and closing an open portion formed at the front side of the helmet body 10, and is rotatably coupled to two sides of the helmet body 10. Specifically, the shield 20 may be rotatably coupled to the helmet body 10 through the support member 100 and the base member 300. Here, the shield 20 rotates with respect to the helmet body 10 and is rotatable from a first position to a second position. For example, the first position may refer to a position at which the shield 20 closes the open portion (see FIG. 1A), and the second position may refer to a position at which the shield 20 opens the open portion (see FIG. 1B).

In addition, a chin guard 30 plays a role in protecting the wearer's chin, and may be extended in an arc shape such that it is disposed at the front side of the wearer's chin. In this instance, the chin guard 30 may be rotatable with two ends rotatably coupled to the two sides of the helmet body 10. For example, the chin guard 30 may be rotatably coupled to the helmet body 10 through an arm 31 and first and second links 32, 33 (see FIG. 2). However, the first and second links 32, 33 and the arm 31 in relation to the chin guard 30 has little direct relevance to the present disclosure, and thus a detailed description of the operation of the arm 31 and the first and second links 32, 33 is omitted, and illustration in some drawings is omitted if necessary.

As shown in FIGS. 2 and 3, the shield rotation control means according to this embodiment may include the support member 100 and the stopper means 200. Here, one side of the support member 100 may support the shield 20, and the other side may be rotatably coupled to the base member 300. Specifically, a fastening portion 105 is formed at one side of the support member 100, and when the end of the shield 20 is inserted into the fastening portion 105, the shield 20 may be coupled to the support member 100. Additionally, a sliding portion 110 may be formed at the other side of the support member 100, and the sliding portion 110 may slide in contact with the periphery of the base member 300. For example, a sliding wall 310 extended in an arc shape facing the support member 100 may be formed in the periphery of the base member 300, and the sliding portion 110 of the support member 100 may be also extended in an arc shape to conform to the sliding wall 310, and thus the sliding portion 110 of the support member 100 may slide along the sliding wall 310 of the base member 300. In this instance, the support member 100 may rotate with respect to the base member 300 together with the shield 20.

Meanwhile, the support member 100 may include an extended portion 120 extended in a way that the extended portion 120 overlaps the base member 300. The stopper means 200 may be coupled to the extended portion 120 to stop the support member 100 at a predetermined position. Here, the stopper means 200 is provided with the elastic force toward the base member 300. Specifically, the stopper means 200 may be rotatably coupled to the support member 100 around a rotation axis 210. In this instance, the stopper means 200 may include an elastic means to provide the elastic force to cause the stopper means 200 to rotate around the rotation axis 210 in one direction (in the counterclockwise direction on the basis of the drawing). For example, the elastic means may be a torsion spring. As described above, when the elastic means provides the elastic force to the stopper means 200 in one direction, the elastic force acts on the stopper means 200 toward the base member 300 (the sliding wall 310). In this instance, one side (the upper end) of the stopper means 200 may press the sliding wall 310 (extended such that it faces the stopper means 200) of the base member 300 by the elastic force, to cause the support member 100 to stop. In the end, the support member 100 may stop at the predetermined position by the elastic force of the stopper means 200.

However, one side (the upper end) of the stopper means 200 may not directly contact the sliding wall 310 of the base member 300. For example, a noise absorber member 220 may be present between the stopper means 200 and the base member 300. Here, the noise absorber member 220 is rotatably coupled to the extended portion 120 of the support member 100. Accordingly, when the stopper means 200 presses the noise absorber member 220 by the elastic force of the stopper means 200, the noise absorber member 220 rotates toward the sliding wall 310 of the base member 300 and comes into contact with the sliding wall 310. That is, the noise absorber member 220 may contact the base member 300 by the elastic force of the stopper means 200, and in this instance, a frictional force is generated between the noise absorber member 220 and the sliding wall 310 of the base member 300. The support member 100 may stop at the predetermined position by the frictional force. Additionally, the noise absorber member 220 may be made of elastics to prevent noise that may occur due to the movement in contact with the sliding wall 310. In this instance, the noise absorber member 220 is not limited to a particular material and may be made of silicone.

Meanwhile, the stopper means 200 may include a first hook portion 230 formed in the shape of a hook. In this instance, the first hook portion 230 may be formed at the other side (the lower end) of the stopper means 200. Additionally, an auxiliary member (the arm 31) coupled to the base member 300 and related to the rotation of the chin guard 30 may have a second hook portion 240 formed in the shape of a hook so as to be coupled to the first hook portion 230. In this instance, the elastic means provides the elastic force in a direction (the counterclockwise direction) in which the first hook portion 230 is coupled to the second hook portion 240. That is, by the elastic force of the elastic means, the elastic force acts on one side (the upper end) of the stopper means 200 toward the base member 300 (the sliding wall 310), and the elastic force acts on the other side (the lower end) of the stopper means 200 toward the second hook portion 240. As described above, by the action of the elastic force of the elastic means, the first hook portion 230 and the second hook portion 240 may be coupled to each other, thereby fixing the stopper means 200 and the support member 100 while preventing them from arbitrarily moving. However, when an external force such as the wearer's force acts on the support member 100, the stopper means 200 may rotate in the opposite direction (the clockwise direction) to the elastic force, the first hook portion 230 may separate from the second hook portion 240, and the support member 100 may rotate upward together with the shield 20. Although the foregoing description discloses that the second hook portion 240 is formed in the auxiliary member (the arm 31), the present disclosure is not necessarily limited thereto, and the second hook portion 240 may be directly formed in the base member 300.

As shown in FIGS. 2 and 4, the stopper means 200 may include a protruding portion 250 that protrudes toward the base member 300. Here, the protruding portion 250 may protrude from one side (the upper end) of the stopper means 200 in the shape of a rod. Meanwhile, the base member 300 may have a slot 320 extended in an arc shape along the direction in which the support member 100 rotates. The protruding portion 250 of the stopper means 200 may be inserted into the slot 320 of the base member 300 and slide along the slot 320 of the base member 300. Accordingly, when the support member 100 rotates with respect to the base member 300, the protruding portion 250 of the stopper means 200 may slide along the slot 320 of the base member 300.

As described above, the elastic force of the elastic means acts on the stopper means 200 in one direction (the counterclockwise direction). Accordingly, the elastic force may also act on the protruding portion 250 formed at one side (the upper end) of the stopper means 200 in one direction (the counterclockwise direction (on the basis of FIG. 2)), and the protruding portion 250 of the stopper means 200 may slide in contact with one sidewall of the slot 320 of the base member 300. As described above, as the protruding portion 250 of the stopper means 200 contacts the slot 320 of the base member 300, the protruding portion 250 may guide the stable rotation of the support member 100 with respect to the base member 300.

Additionally, a first recessed portion 321 recessed in the direction of the elastic force of the elastic means provided to the protruding portion 250 (in a direction close to the sliding wall 310) may be formed at a first end (the lower end) of the slot 320. The protruding portion 250 of the stopper means 200 may be coupled to the first recessed portion 321. That is, since the elastic force of the elastic means acts on the protruding portion 250 of the stopper means 200, the protruding portion 250 of the stopper means 200 may rotate toward the first recessed portion 321 by the elastic force, and may be disposed in the first recessed portion 321. As described above, when the protruding portion 250 of the stopper means 200 is disposed in the first recessed portion 321 of the slot 320, the stopper means 200 and the support member 100 may be fixed while preventing them from arbitrarily moving, but a force that fixes the stopper means 200 and the support member 100 is substantially weak. In case where the external force acts on the support member 100, the stopper means 200 may rotate in the opposite direction (the clockwise direction (on the basis of FIG. 2)) to the elastic force, the protruding portion 250 of the stopper means 200 may separate from the first recessed portion 321 of the slot 320, and the support member 100 may rotate upward together with the shield 20.

Meanwhile, while the first hook portion 230 is coupled to the second hook portion 240, the stopper means 200 may rotate in the opposite direction (the clockwise direction (on the basis of FIG. 2)) to the elastic force, and in this instance, for a movement space of the protruding portion 250 of the stopper means 200, the slot 320 may have a first auxiliary recessed portion 323 at the opposite side to the first recessed portion 321.

In addition, a second recessed portion 325 recessed in the direction of the elastic force of the elastic means provided to the protruding portion 250 (in the direction close to the sliding wall 310) may be formed at a second end (the upper end) of the slot 320. The protruding portion 250 of the stopper means 200 may be coupled to the second recessed portion 325. That is, since the elastic force of the elastic means acts on the protruding portion 250 of the stopper means 200, the protruding portion 250 of the stopper means 200 may rotate toward the second recessed portion 325 by the elastic force, and may be coupled to the second recessed portion 325. As described above, when the protruding portion 250 of the stopper means 200 is coupled to the second recessed portion 325 of the slot 320, the stopper means 200 and the support member 100 may be fixed while preventing them from arbitrarily moving. However, in case where the external force such as the wearer's force acts on the support member 100, the stopper means 200 may rotate in the opposite direction (the clockwise direction (on the basis of FIG. 2)) to the elastic force, the protruding portion 250 of the stopper means 200 may separate from the second recessed portion 325 of the slot 320, and the support member 100 may rotate downward together with the shield 20.

Meanwhile, while the first hook portion 230 is coupled to the second hook portion 240 (when the auxiliary member (the arm 31) rotates upward after the support member 100 rotates upward), the stopper means 200 may rotate in the opposite direction (the clockwise direction (on the basis of FIG. 2)) to the elastic force, and in this instance, for a movement space of the protruding portion 250 of the stopper means 200, the slot 320 may have a second auxiliary recessed portion 327 at the opposite side to the second recessed portion 325.

In addition, to increase the coupling strength between the protruding portion 250 of the stopper means 200 and the second recessed portion 325 of the slot 320, a first coupling portion 326 may be formed in the second recessed portion 325 of the slot 320, and a second coupling portion 255 may be formed in the protruding portion 250 of the stopper means 200. Specifically, the first coupling portion 326 may be extended to be angled at one side of the second recessed portion 325 of the slot 320, and the second coupling portion 255 may be recessed at one side of the protruding portion 250 of the stopper means such that it is angled to conform to the first coupling portion 326. As described above, the protruding portion 250 of the stopper means 200 is coupled to the second recessed portion 325 by the elastic force, and in this instance, the first coupling portion 326 of the second recessed portion 325 and the second coupling portion 255 of the protruding portion 250 come into contact with each other, thereby enhancing the coupling strength between the protruding portion 250 of the stopper means 200 and the second recessed portion 325 of the slot 320.

As shown in FIG. 4, the shield rotation control means may include an elastic member 400 and a serrated portion 500 to control the rotation of the support member 100. Here, the elastic member 400 is disposed in the support member 100 such that it protrudes in a curved shape toward the base member 300. For example, the elastic member 400 may be a snap spring. Additionally, the serrated portion 500 may be formed in the base member 300 such that it is extended along the direction in which the support member 100 rotates. For example, the serrated portion 500 may be extended in an arc shape along the periphery of the base member 300, facing the elastic member 400. Accordingly, when the elastic member 400 is coupled to the support member 100, the protruded portion in a curved shape may be coupled to the serrated portion 500 formed in the base member 300. In the end, when the support member 100 rotates with respect to the base member 300, the elastic member 400 may move along the serrated portion 500. Specifically, the serrated portion 500 may include a first groove 510 having a curvature corresponding to the curvature of the elastic member 400 at one end (the lower end), and a second groove 520 having a curvature corresponding to the curvature of the elastic member 400 at the other end (the upper end). As described above, since the first and second grooves 510, 520 having the curvature corresponding to the curvature of the elastic member 400 are formed at the two ends (the upper and lower ends) of the serrated portion 500, the elastic member 400 may be inserted into the first and second grooves 510, 520. In this instance, the elastic member 400 and the support member 100 may be fixed while preventing them from arbitrarily moving. Here, when the elastic member 400 is inserted into the first groove 510, the shield 20 may be in the first position (the closed position of the open portion), and when the elastic member 400 is inserted into the second groove 520, the shield 20 may be in the second position (the open position of the open portion). However, when the external force such as the wearer's force acts on the support member 100, as the elastic member 400 bends, the elastic member 400 may separate from the first and second grooves 510, 520, and the support member 100 may rotate together with the shield 20.

Meanwhile, the serrated portion 500 may include multi-grooves 530 having a larger curvature (having a smaller radius of curvature than the radius of curvature of the elastic member 400) than the curvature of the elastic member 400 between the first groove 510 and the second groove 520. In the end, since the multi-grooves 530 that are larger than the curvature of the elastic member 400 are formed between the two ends of the serrated portion 500, the elastic member 400, while in bent state, may pass through the multi-grooves 530. That is, when the wearer rotates the support member 100, the elastic member 400 bends and passes through the multi-grooves 530. In this instance, the wearer may feel a clicking sensation. Additionally, when the wearer stops manipulation, the elastic member 400 in bent state may be coupled to the multi-grooves 530, causing the support member 100 to temporarily stop at the predetermined position.

In addition, the serrated portion 500 may include a third groove 540 having a curvature corresponding to the curvature of the elastic member 400 at a predetermined distance from the first groove 510 formed at one end (the lower end). As described above, since the third groove 540 having the curvature corresponding to the curvature of the elastic member 400 is formed at the predetermined distance from one end (the lower end) of the serrated portion 500, the elastic member 400 may be inserted into the third groove 540. In this instance, the elastic member 400 and the support member 100 may be fixed while preventing them from arbitrarily moving. Here, when the elastic member 400 is inserted into the third groove 540, the shield 20 may be in an initial open position (a position at which the open portion is partially open). However, when the external force such as the wearer's force acts on the support member 100, as the elastic member 400 bends, the elastic member 400 may separate from the third groove 540, and the support member 100 may rotate together with the shield 20.

Although the foregoing description discloses that the elastic member 400 is formed in the support member 100 and the serrated portion 500 is formed in the base member 300, the present disclosure is not necessarily limited thereto, and the elastic member 400 may be formed in the base member 300, and the serrated portion 500 may be formed in the support member 100.

As shown in FIGS. 2 and 3, a projecting portion 600 that protrudes toward the support member 100 is formed in the base member 300 so that it is held against one side of the support member 100, and the elastic force may act on the projecting portion 600 toward the base member 300. Specifically, the projecting portion 600 may protrude in the shape of a hook so that it is held against the upper side of the extended portion 120 of the support member 100. Accordingly, when the projecting portion 600 is held against the upper side of the extended portion 120 of the base member 300, the support member 100 may be fixed while preventing it from arbitrarily moving. In this instance, the shield 20 may be in the first position (the closed position of the open portion). However, since the elastic force acts on the projecting portion 600 toward the base member 300, when the external force such as the wearer's force acts on the support member 100, as the projecting portion 600 bends, the projecting portion 600 may separate from the extended portion 120 of the support member 100, and the support member 100 may rotate together with the shield 20.

MODE FOR INVENTION

FIGS. 5 to 10 are side views showing an operation process of the shield rotation control means according to an embodiment of the present disclosure, and the operation process of the shield rotation control means according to this embodiment will be described with regard to FIGS. 5 to 10.

Figure 5:
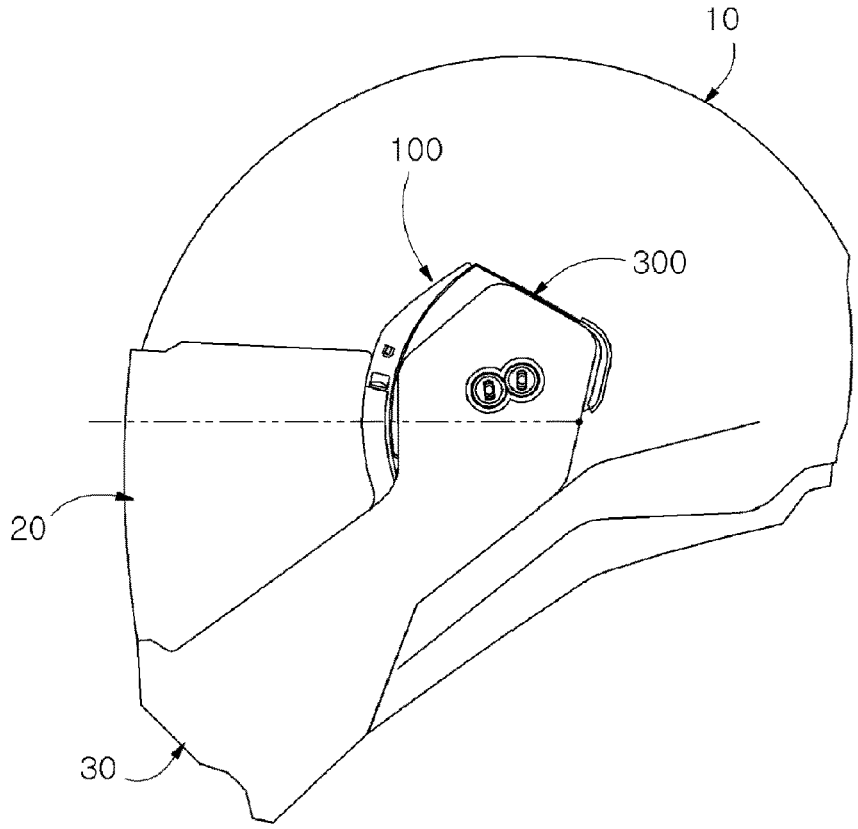
FIGS. 5 to 10 are plan diagrams showing an operation process of a shield rotation control means according to an embodiment of the present disclosure.
Figure 5:
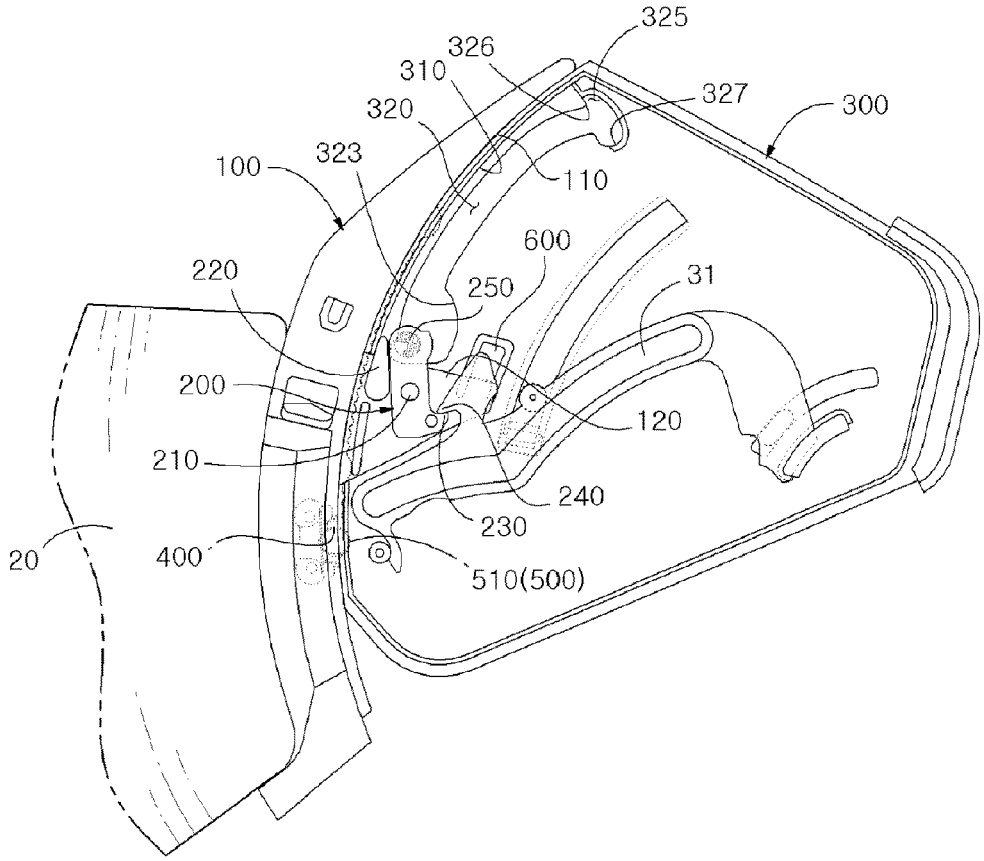

To begin with, as shown in FIG. 5, when the shield 20 closes the open portion (the first position), the first hook portion 230 of the stopper means 200 is coupled to the second hook portion 240 formed in the auxiliary member (the arm 31) by the elastic force of the elastic means. At the same time, the elastic member 400 coupled to the support member 100 is inserted into the first groove 510 of the serrated portion 500 formed in the base member 300. Additionally, the projecting portion 600 formed in the base member 300 is held against the extended portion 120 of the support member 100. To sum, when the shield 20 closes the open portion, the first hook portion 230 of the stopper means 200 is coupled to the second hook portion 240, the elastic member 400 is coupled to the first groove 510 of the serrated portion 500, and the projecting portion 600 is held against the extended portion 120 of the support member 100. In the end, when the shield 20 closes the open portion, the support member 100 is fixed by three fixing methods, thereby preventing it from arbitrarily moving.

Figure 6:
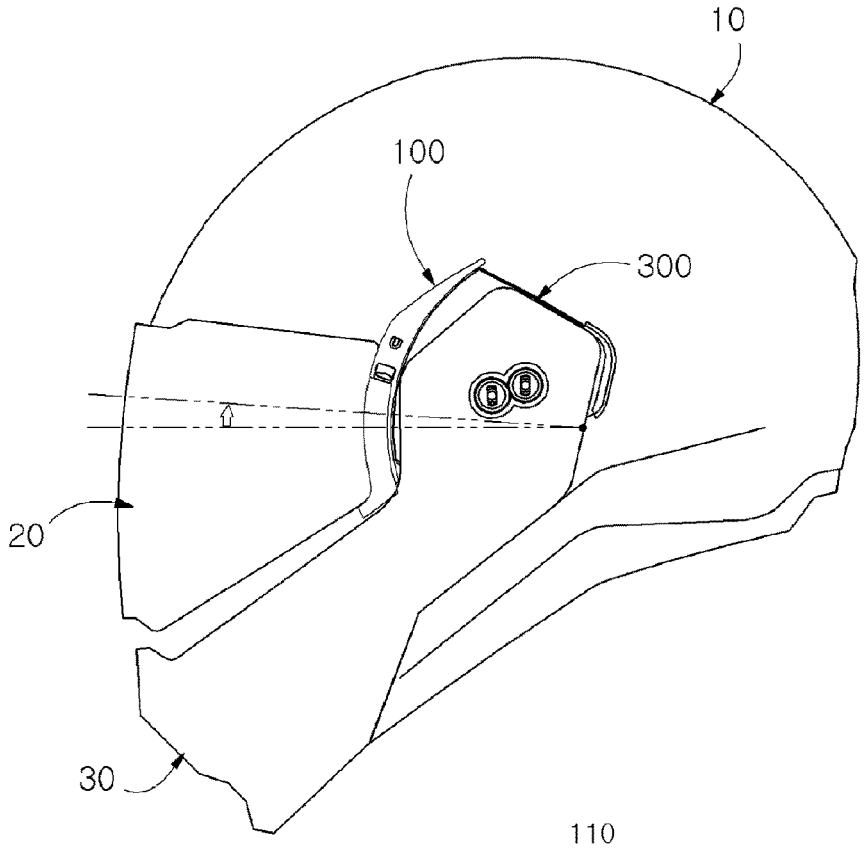
Figure 6:
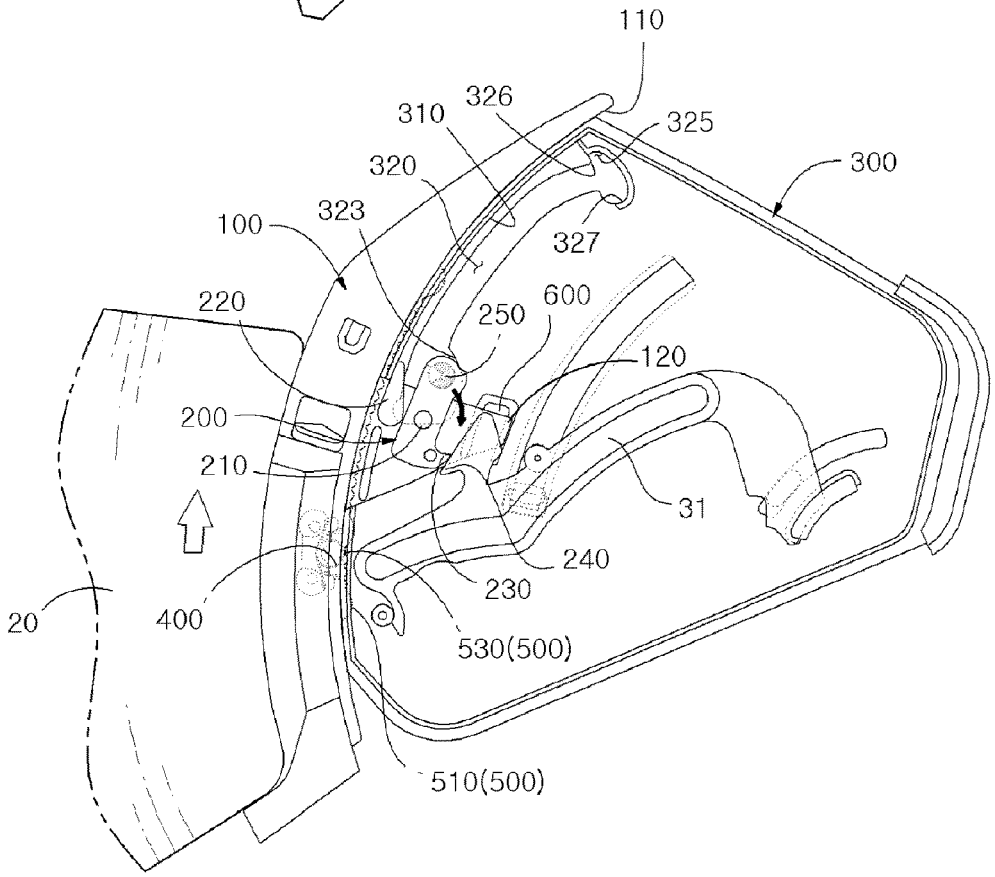

Subsequently, as shown in FIG. 6, when the shield 20 rotates in a direction of opening the open portion, the stopper means 200 rotates in the opposite direction (the clockwise direction) to the elastic force, and the first hook portion 230 of the stopper means 200 separates from the second hook portion 240. At the same time, as the elastic member 400 coupled to the support member 100 bends, the elastic member 400 separate from the first groove 510. Additionally, the projecting portion 600 formed in the base member 300 bends and separates from the extended portion 120 of the support member 100. To sum, when the shield 20 rotates in the direction of opening the open portion, the first hook portion 230 of the stopper means 200 separates from the second hook portion 240, the elastic member 400 separates from the first groove 510 of the serrated portion 500, and the projecting portion 600 separates from the extended portion 120 of the support member 100. In the end, when the shield 20 rotates in the direction of opening the open portion, the three fixing methods of fixing the support member 100 may undo and the support member 100 may rotate with respect to the base member 300.

Figure 7:
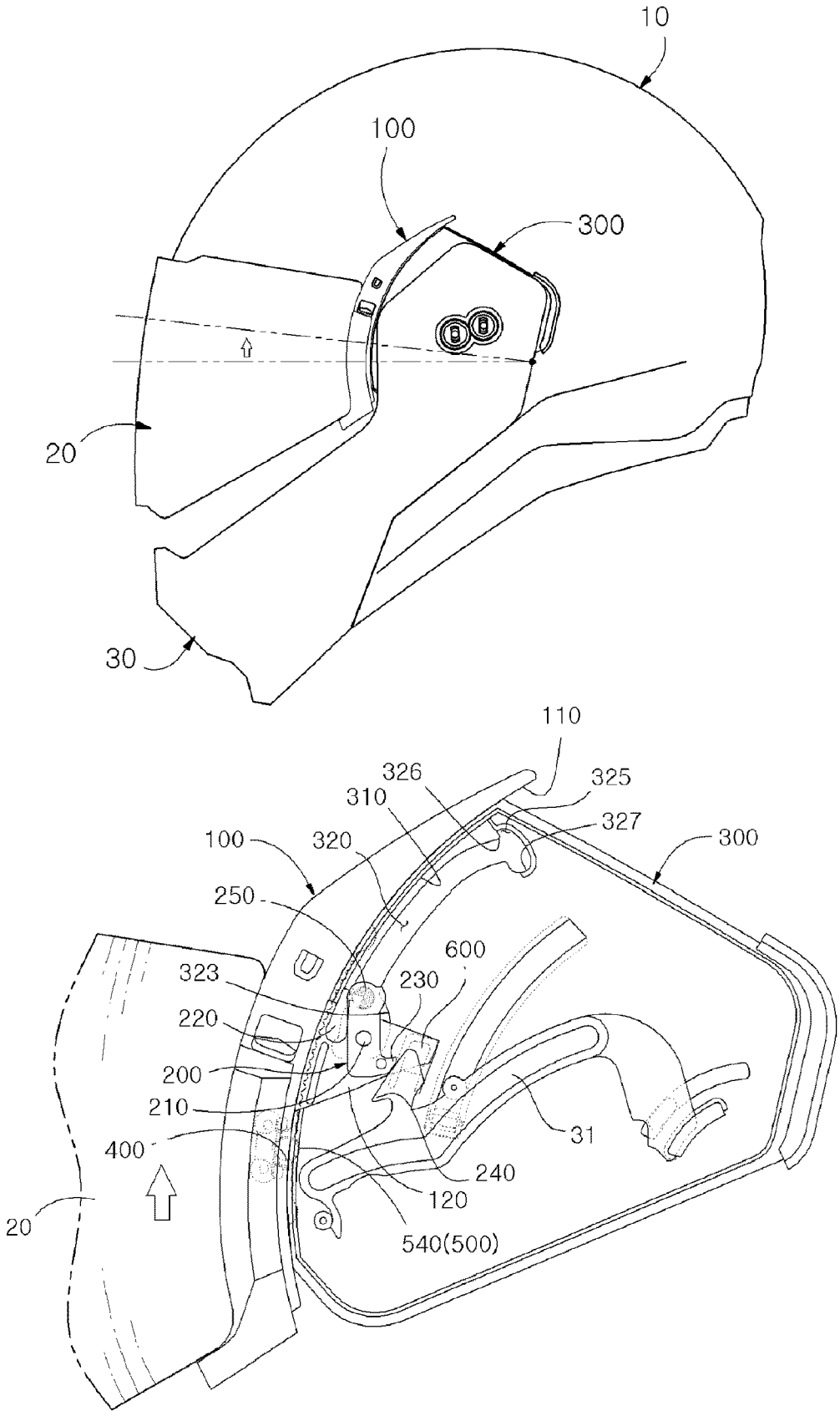

Subsequently, as shown in FIG. 7, when the shield 20 further rotates in the direction of opening the open portion, the elastic member 400 coupled to the support member 100 is inserted into the third groove 540 of the serrated portion 500 formed in the base member 300. Accordingly, the support member 100 may be fixed while preventing it from arbitrarily moving, and in this instance, the shield 20 may be in the initial open position (the position at which the open portion is partially open).

Figure 8:
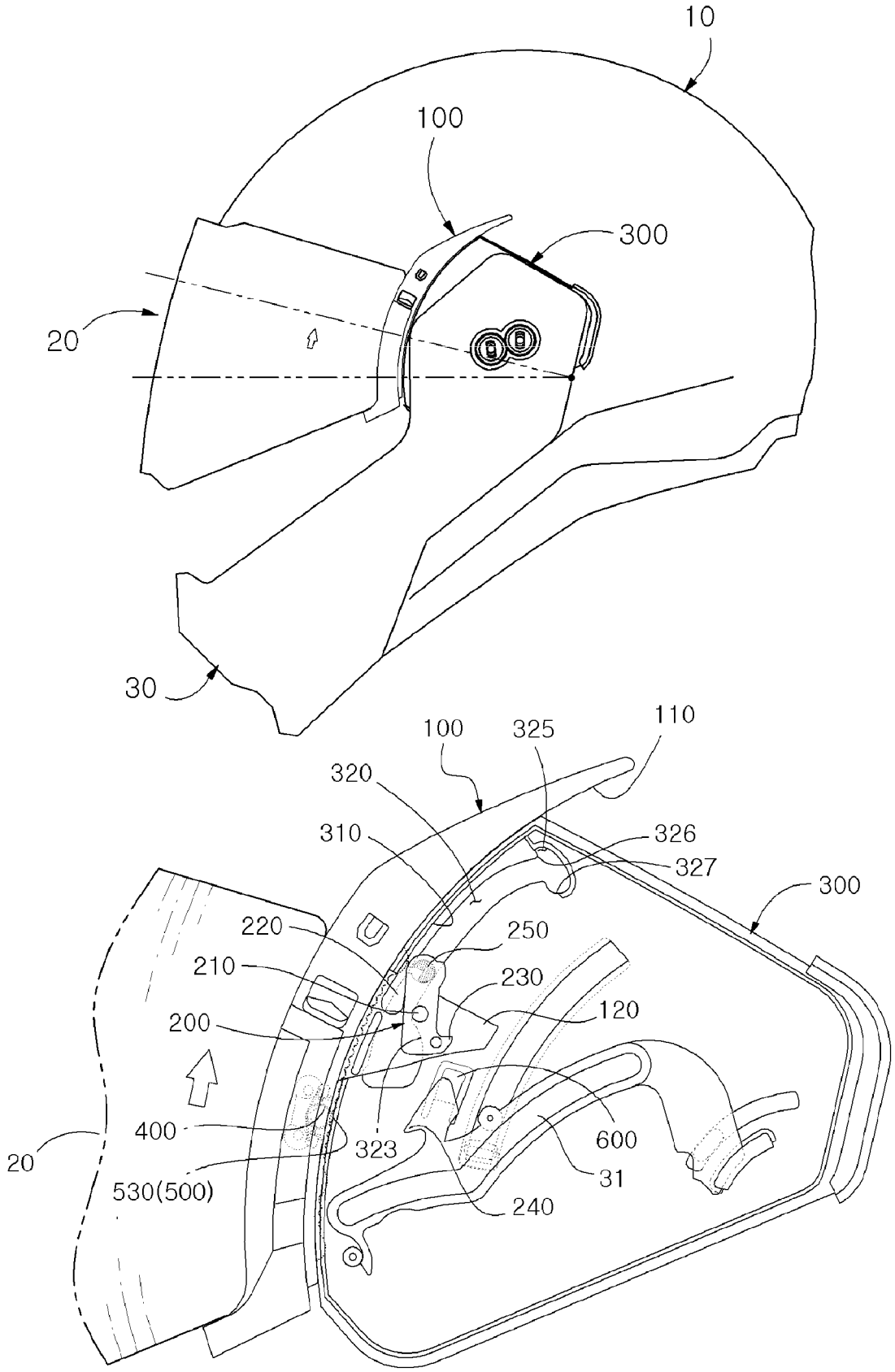

Subsequently, as shown in FIG. 8, when the shield 20 further rotates in the direction of opening the open portion, the stopper means 200 presses the noise absorber member 220 by the elastic force of the elastic means, and accordingly the noise absorber member 220 presses the sliding wall 310 of the base member 300. Additionally, the elastic member 400 bends and passes through the multi-grooves 530. Accordingly, when the wearer stops manipulation, the stopper means 200 (the noise absorber member 220) may press the sliding wall 310 of the base member 300, and the elastic member 400 in bent state may be coupled to the multi-grooves 530, causing the support member 100 to stop at the predetermined position.

Figure 9:
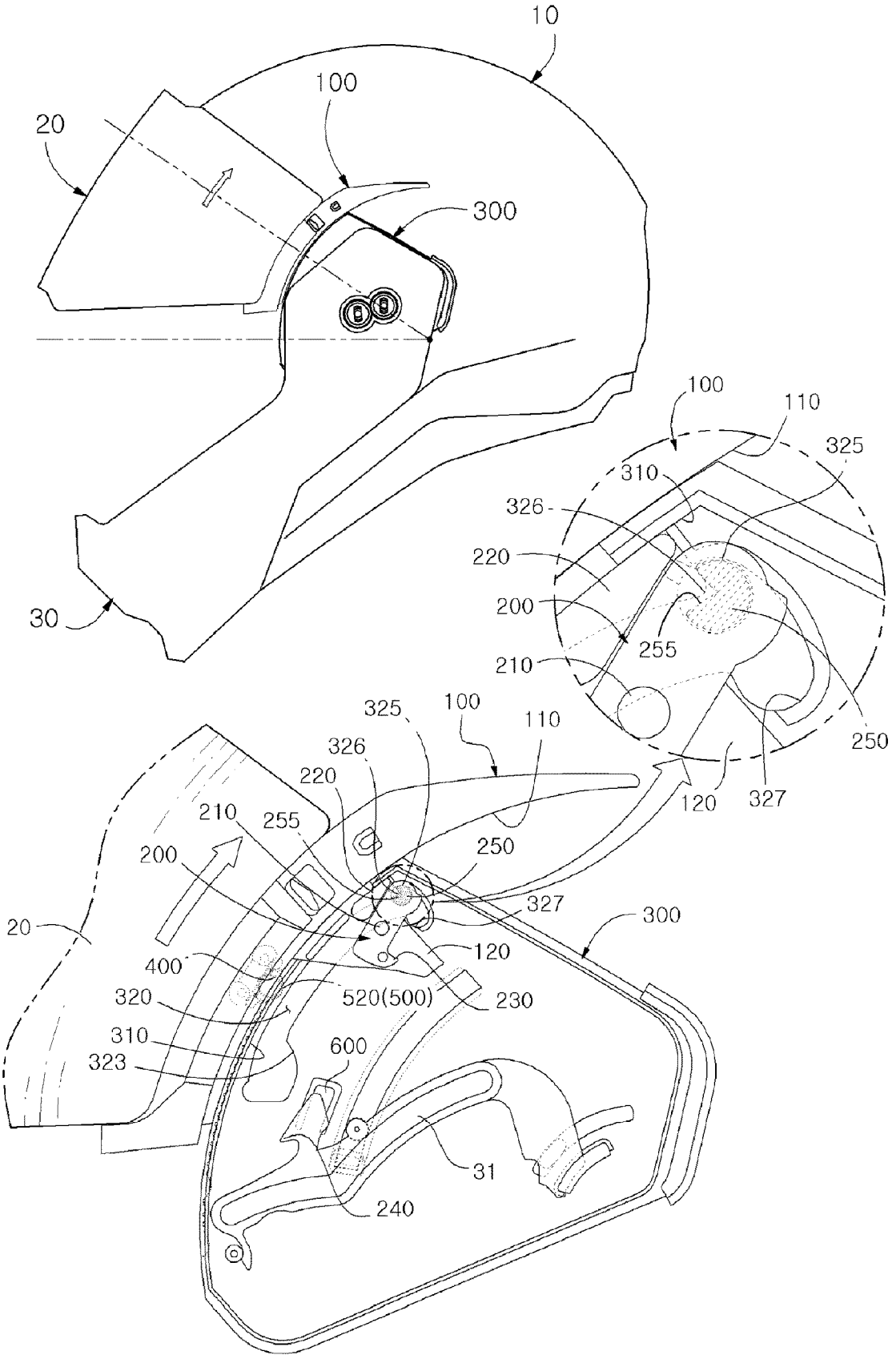

Subsequently, as shown in FIG. 9, when the shield 20 completely opens the open portion (the second position), the protruding portion 250 of the stopper means 200 is coupled to the second recessed portion 325 formed at the second end (the upper end) of the slot 320, and the elastic member 400 coupled to the support member 100 is inserted into the second groove 520 of the serrated portion 500 formed in the base member 300. In the end, when the shield 20 opens the open portion, the support member 100 may be fixed by two fixing methods, thereby preventing it from arbitrarily moving. In particular, the first coupling portion 326 of the second recessed portion 325 and the second coupling portion 255 of the protruding portion 250 may be coupled in contact with each other, thereby enhancing the coupling strength between the protruding portion 250 of the stopper means 200 and the second recessed portion 325 of the slot 320.

Figure 10:
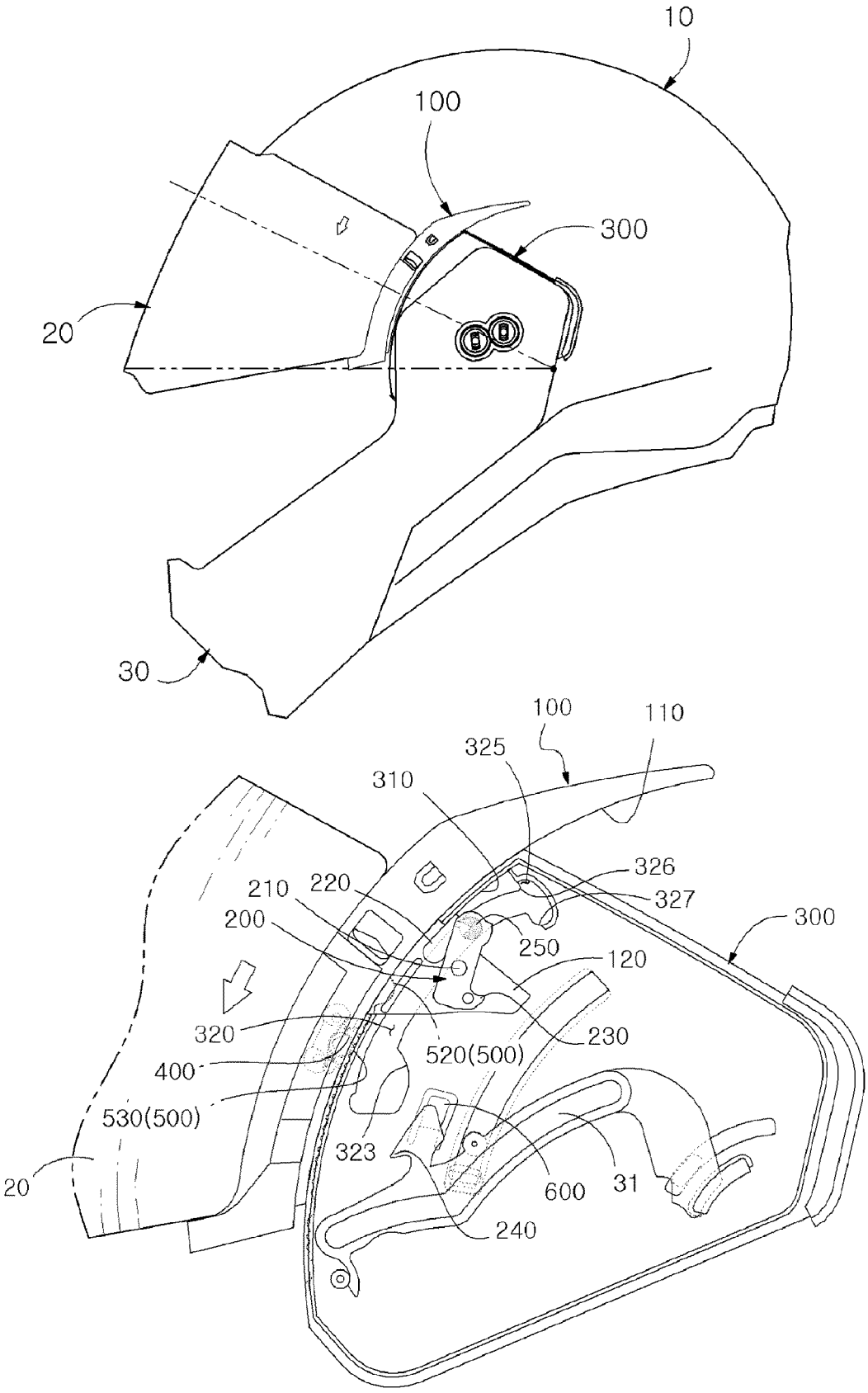

Subsequently, as shown in FIG. 10, when the shield 20 rotates in the direction of closing the open portion, the stopper means 200 rotates in the opposite direction (the clockwise direction) to the elastic force, the protruding portion 250 of the stopper means 200 separates from the second recessed portion 325 of the slot 320, and as the elastic member 400 coupled to the support member 100 bends, the elastic member 400 separates from the second groove 520. In the end, when the shield 20 rotates in the direction of closing the open portion, the two methods of fixing the support member 100 may undo and the support member 100 may rotate with respect to the base member 300.

Additionally, when the shield 20 rotates in the direction of closing the open portion, the stopper means 200 presses the noise absorber member 220 by the elastic force of the elastic means, and accordingly the noise absorber member 220 presses the sliding wall 310 of the base member 300.

Additionally, the elastic member 400 bends and passes through the multi-grooves 530. Accordingly, when the wearer stops manipulation, the stopper means 200 (the noise absorber member 220) may press the sliding wall 310 of the base member 300, and the elastic member 400 in bent state may be coupled to the multi-grooves 530, causing the support member 100 to stop at the predetermined position.

In the shield rotation control means according to this embodiment, when the shield 20 is in the closed position of the open portion, when the shield 20 is in the initial open position of the open portion, or when the shield 20 is in the complete open position of the open portion, the support member 100 is fixed by the predetermined fixing method.

Additionally, the shield rotation control means according to this embodiment may stably stop the shield 20 coupled to the support member 100 at the predetermined position by stopping the support member 100 using the stopper means 200 having elasticity during rotation of the support member 100.

While the present disclosure has been hereinabove described in detail through the specific embodiments, this is provided to describe the present disclosure in detail, and the present disclosure is not limited thereto, and it is obvious that modifications or changes may be made by those having ordinary skill in the art within the technical spirit of the present disclosure.

Such modifications and changes of the present disclosure fall in the scope of the present disclosure, and the scope of protection of the present disclosure will be apparent by the appended claims.

[Detailed Description of Main Elements]

| | |
|---|---|
| 10: Helmet body | 20: Shield |
| 30: Chin guard | 31: Arm |
| 32: First link | 33: Second link |
| 100: Support member | 110: Sliding portion |
| 120: Extended portion | 105: Fastening portion |
| 200: Stopper means | 210: Rotation axis |
| 220: Noise absorber member | 230: First hook portion |
| 240: Second hook portion | 250: Protruding portion |
| 255: Second coupling portion | 300: Base member |
| 310: Sliding wall | 320: Slot |
| 321: First recessed portion | 323: First auxiliary recessed portion |
| 325: Second recessed portion | 326: First coupling portion |
| 327: Second auxiliary recessed portion | 400: Elastic member |
| 500: Serrated portion | 510: First groove |
| 520: Second groove | 530: Multi-grooves |
| 540: Third groove | 600: Projecting portion |

INDUSTRIAL APPLICABILITY

The present disclosure provides the shield rotation control means which may stably stop the shield coupled to the support member at the predetermined position by stopping the support member using the stopper means having elasticity during rotation of the support member.

The invention claimed is:

1. A shield rotation control means, comprising:

a support member which supports a shield and rotates with respect to a base member; and a stopper means which is coupled to the support member, wherein an elastic force is provided toward the base member, wherein the support member is stopped by the elastic force of the stopper means, wherein the stopper means is rotatably coupled to the support member around a rotation axis, wherein the stopper means includes an elastic means to provide the elastic force to rotate the stopper means around the rotation axis in one direction, wherein the stopper means includes a protruding portion which protrudes toward the base member, wherein the base member has a slot extended along a direction in which the support member rotates, and wherein when the support member rotates with respect to the base member, the protruding portion slides along the slot.

2. The shield rotation control means according to claim 1, wherein the stopper means includes a first hook portion, wherein an auxiliary member coupled to the base member or the base member includes a second hook portion coupled to the first hook portion, and wherein the elastic means provides the elastic force in a direction in which the first hook portion is coupled to the second hook portion.

3. The shield rotation control means according to claim 1, wherein a first recessed portion recessed in a direction of the elastic force of the elastic means provided to the protruding portion is formed at a first end of the slot, and wherein the protruding portion is coupled to the first recessed portion.

4. The shield rotation control means according to claim 1, wherein a second recessed portion recessed in a direction of the elastic force of the elastic means provided to the protruding portion is formed at a second end of the slot, and wherein the protruding portion is coupled to the second recessed portion.

5. The shield rotation control means according to claim 4, wherein a first coupling portion extended to be angled is formed at one side of the second recessed portion, wherein a second coupling portion recessed to be angled to conform to the first coupling portion is formed at one side of the protruding portion, and wherein when the protruding portion is coupled to the second recessed portion, the first coupling portion and the second coupling portion come into contact with each other.

6. The shield rotation control means according to claim 1, wherein a noise absorber member is present between the stopper means and the base member.

7. The shield rotation control means according to claim 6, wherein the noise absorber member is rotatably coupled to the support member, and wherein the noise absorber member contacts the base member by the elastic force of the stopper means.

8. The shield rotation control means according to claim 7, wherein the noise absorber member is made of silicone.

9. The shield rotation control means according to claim 1, wherein the shield rotation control means comprises:

an elastic member disposed in any one of the support member and the base member such that the elastic member protrudes in a curved shape toward the other one of the support member and the base member; and a serrated portion formed in the other one of the support member and the base member such that the serrated portion is extended along a direction in which the support member rotates, and wherein when the support member rotates with respect to the base member, the elastic member moves along the serrated portion.

10. The shield rotation control means according to claim 9, wherein the serrated portion includes a first groove having a curvature corresponding to a curvature of the elastic member at one end, and a second groove having a curvature corresponding to the curvature of the elastic member at an opposite end, and wherein the serrated portion includes multi-grooves having a larger curvature than the curvature of the elastic member between the first groove and the second groove.

11. The shield rotation control means according to claim 10, wherein the serrated portion includes a third groove having a curvature corresponding to the curvature of the elastic member at a predetermined distance from the first groove.

12. The shield rotation control means according to claim 1, wherein the base member includes a projecting portion which protrudes toward the support member so that the projecting portion is held against one side of the support member, and wherein the elastic force acts on the projecting portion toward the base member.

13. A shield rotation control means, comprising:

a support member which supports a shield and rotates with respect to a base member; and a stopper means which is coupled to the support member, wherein an elastic force is provided toward the base member, wherein the support member is stopped by the elastic force of the stopper means, wherein a noise absorber member is present between the stopper means and the base member, wherein the noise absorber member is rotatably coupled to the support member, and wherein the noise absorber member contacts the base member by the elastic force of the stopper means.

14. The shield rotation control means according to claim 13, wherein the noise absorber member is made of silicone.

15. The shield rotation control means according to claim 13, wherein the stopper means includes a first hook portion, wherein an auxiliary member coupled to the base member or the base member includes a second hook portion coupled to the first hook portion, and wherein an elastic means provides the elastic force in a direction in which the first hook portion is coupled to the second hook portion.

16. A shield rotation control means, comprising:

a support member which supports a shield and rotates with respect to a base member; and a stopper means which is coupled to the support member, wherein an elastic force is provided toward the base member, wherein the support member is stopped by the elastic force of the stopper means, wherein the shield rotation control means comprises:

an elastic member disposed in any one of the support member and the base member such that the elastic member protrudes in a curved shape toward the other one of the support member and the base member; and a serrated portion formed in the other one of the support member and the base member such that the serrated portion is extended along a direction in which the support member rotates, and wherein when the support member rotates with respect to the base member, the elastic member moves along the serrated portion.

17. The shield rotation control means according to claim 16, wherein the serrated portion includes a first groove having a curvature corresponding to a curvature of the elastic member at one end, and a second groove having a curvature corresponding to the curvature of the elastic member at an opposite end, and wherein the serrated portion includes multi-grooves having a larger curvature than the curvature of the elastic member between the first groove and the second groove.

18. The shield rotation control means according to claim 17, wherein the serrated portion includes a third groove having a curvature corresponding to the curvature of the elastic member at a predetermined distance from the first groove.

* * * * *